US007320647B2

(12) United States Patent
Murray

(10) Patent No.: US 7,320,647 B2
(45) Date of Patent: Jan. 22, 2008

(54) GOLF PUTTER LENGTH ADJUSTMENT HOLDER DEVICE

(76) Inventor: Dean D. Murray, 619 Honeywood Place, Waterloo (CA) N2T 2T6

( * ) Notice: Subject to any disclaimer, the term of this patent is extended or adjusted under 35 U.S.C. 154(b) by 0 days.

(21) Appl. No.: 11/141,277

(22) Filed: May 31, 2005

(65) Prior Publication Data

US 2006/0270486 A1 Nov. 30, 2006

(51) Int. Cl.
*A63B 53/16* (2006.01)

(52) U.S. Cl. ..... 473/296; 403/371

(58) Field of Classification Search ..... 473/239, 473/296, 294–295, 298–299; 403/377, 369, 403/294, 370–371
See application file for complete search history.

(56) References Cited

U.S. PATENT DOCUMENTS 3,284,114 A * 11/1966 McCord, Jr. et al. ..... 403/370
3,539,185 A 11/1970 Andis
4,674,747 A 6/1987 Mazzocco et al.
5,133,553 A 7/1992 Divnick
5,282,619 A * 2/1994 Napolitano et al. ..... 473/239
D363,519 S 10/1995 Gooden
5,649,870 A 7/1997 Harrison
6,776,724 B1 8/2004 Siemsglusz
6,780,120 B2 8/2004 Murray
6,875,123 B2 4/2005 Wilson
2002/0111227 A1 8/2002 Wilson
2003/0050131 A1 3/2003 Grace
2003/0083144 A1 5/2003 Shin
2004/0023728 A1 2/2004 Drossos
2004/0198529 A1 10/2004 Moore

* cited by examiner

*Primary Examiner*—Stephen Blau
(74) *Attorney, Agent, or Firm*—The Livingston Firm; Edward M. Livingston; Angela M. Miller

(57) ABSTRACT

A golf putter length adjustment holder device (1) comprising a hollow extension tube that fits over a putter shaft (2). The tube may be telescoping, thereby permitting for quick length conversion of the golf putter. In the alternative, the tube may be of a pre-determined length. Because the golf putter length adjustment holder device (1) fits over a putter, a person need not physically alter an existing putter nor purchase a new adjustable putter to use the present invention.

2 Claims, 2 Drawing Sheets

GOLF PUTTER LENGTH ADJUSTMENT HOLDER DEVICE

BACKGROUND OF THE INVENTION

This invention relates to golf putter length adjustment devices, more particularly, a golf putter length adjustment holder device that converts the length of any putter without physically altering the structure of the putter.

When in the proper putting posture, a person takes his or her stance and leans forward so the eyes are directly over the line of the putt. The arms should hand down loosely and the palms are then placed together around the putter shaft. This stance is achieved only when using a standard, or conventional, putter as the standard putter length typically ranges between 33" to 36". However, many individuals find it difficult to successfully putt using a standard putter as one must have both nerves of steel and minimum wrist action. If one is too nervous, he or she suffers from what is often called the "yips." On the other hand, if one has excess wrist action in his or her putt, he or she is often called "too handsy."

In order to compensate for the yips and being too handsy, belly and long putters are now being welcomed and used by both amateurs and professionals alike in the golfing world. Belly putters, which have a length ranging between 38" to 45", provide a third point of contact at the abdomen of the golfer to provide stability and balance to the stroke. Because the belly putter is anchored against the body of the golfer, wrist action is easier to control while permitting the golfer to remain in the proper stance position. However, the use of belly putters does have some drawbacks, including reduced feel and more difficult distance control.

Long putters, which have a length ranging between 46" to 52", convert the stroke into a more pendulum-type swing, thereby virtually eliminating wrist movement. Because these putters are so long in length, golfers stand upright in his or her stance, rather than leaning forward. Thus, using a long putter also provides stress relief to a golfer's back. However, there is even greater reduced feel and distance control as compared to the belly length putter.

Many golfers would like to own a standard, belly and long length putter so he or she may be able to use it at holes as warranted. However, many do not purchase these three putters as it is quite costly to do so. In addition, the rules only permit 14 clubs in use and carrying three putters would result in removing other important clubs from one's bag. Furthermore, long putters typically do not fit within a golf bag due to excess length and therefore must be shipped or checked while traveling.

Not only does the use of standard, belly and long putters permit a more controlled stroke, but because golfers are not of equal height and weight, the use of varying putter lengths allows for a more customized match. For instance, a golfer who is very tall and thin would require a completely different sized belly putter than a golfer who is very short and stout as each of their abdomens are at different distances from the ground. However, due to the aforementioned problems with owning all three putters, many golfers simply purchase the standard putter only and try to perfect their putts on the standard putter, although the use of a belly and/or long putter may better suite the golfers.

Furthermore, although many golfers change clubs often, many golfers do not change their personal putter for a variety of reasons, such as aesthetics, color, weight, feel and even superstitions. However, the need to have the best suited putter is of great importance as putting is the most personal and intimate part of the game of golf.

Thus, a need exists for a golf putter length adjustment holder device that converts the length of any putter.

The relevant prior art includes the following references:

| Patent No. (U.S. unless stated otherwise) | Inventor | Issue/Publication Date |
|---|---|---|
| 6,780,120 | Murray | Aug. 24, 2004 |
| 2004/0198529 | Moore | Oct. 07, 2004 |
| 5,649,870 | Harrison | Jul. 22, 1997 |
| 2003/0083144 | Shin | May 01, 2003 |
| 3,539,185 | Andis | Nov. 10, 1970 |
| Des. 363,519 | Gooden | Oct. 24, 1995 |
| 2003/0050131 | Grace | Mar. 13, 2003 |
| 6,776,724 | Siemsglusz | Aug. 17, 2004 |
| 2002/0111227 | Wilson | Aug. 15, 2002 |
| 6,875,123 | Wilson | Apr. 05, 2005 |
| 2004/0023728 | Drossos | Feb. 05, 2004 |
| 5,133,533 | Divnick | Jul. 28, 1992 |
| 4,674,747 | Mazzocco et al. | Jun. 23, 1987 |

Although the prior art teaches various adjustable length putters, a person must use putters which are specially made for adjustment or physically alter an existing putter by drilling holes therein or the like. The present invention permits a person to convert his or her own putter to an adjustable putter without physically altering the original putter and without buying a special putter or multiple putters.

SUMMARY OF THE INVENTION

The primary object of the present invention is to provide a golf putter length adjustment holder device that converts the length of any putter.

A further object of the present invention is to provide a golf putter length adjustment holder device that allows for the conversion of a putter length without physically altering the putter itself.

An even further object of the present invention is to provide a golf putter length adjustment holder device that is easy to use.

Another object of the present invention is to provide a golf putter length adjustment holder device that may be used as a measuring device for pro-shops and golf retail stores to determine the correct putter length for an individual.

A further object of the present invention is to provide a golf putter length adjustment holder device that permits a person to use his or her personal standard putter as a belly or long putter.

The present invention fulfills the above and other objects by providing a golf putter length adjustment holder device comprised of an extension tube that fits over the shaft of a standard or belly putter and is connected via a fastening means. The tube may be telescoping, thereby permitting for quick length conversion of the golf putter. In the alternative, the tube may be of a pre-determined length.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
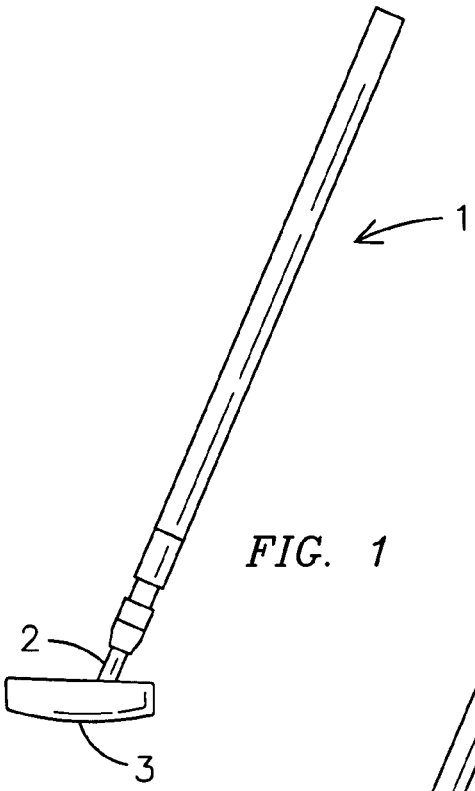
FIG. 1 is a side view of a first embodiment of the present invention as a standard putter.

For purposes of describing the preferred embodiment, the terminology used in reference to the numbered components in the drawings is as follows:

| | | | |
|---|---|---|---|
| 1. | golf putter length adjustment holder device, generally | 8. | inner tube |
| 2. | putter shaft | 9. | outer tube |
| 3. | putter head | 10. | split holder |
| 4. | male connector | 11. | split sleeve |
| 5. | female connector | 12. | first end of outer tube |
| 6. | split ferrule | 13. | second end of outer tube |
| 7. | friction locking mechanism | 14. | aperture |
| | | 15. | nipple |

Figure 2:
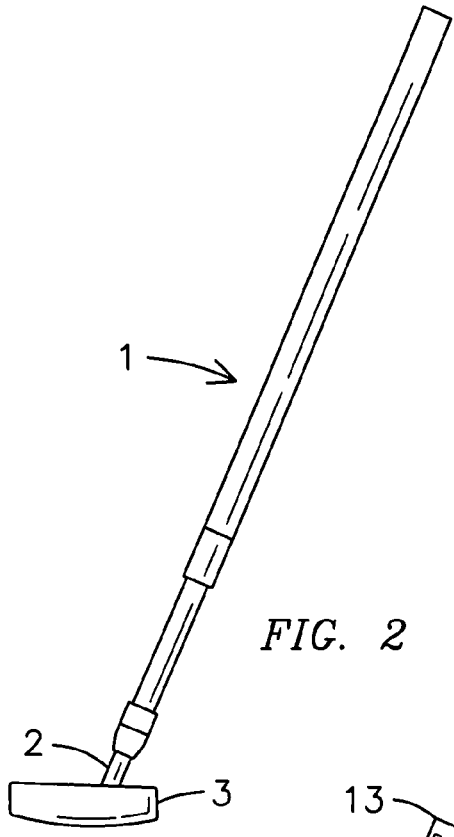
FIG. 2 is a side view of the first embodiment of the present invention as a belly putter.
Figure 3:
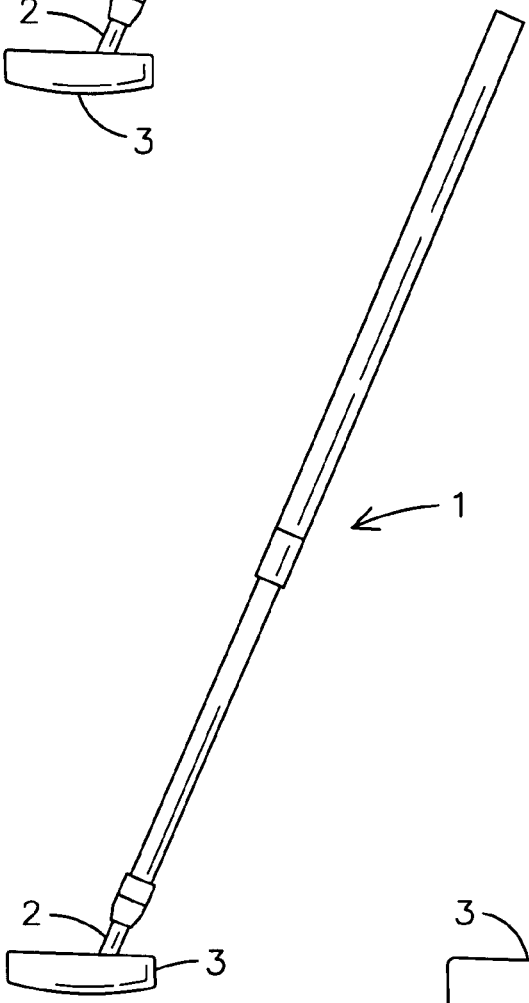
FIG. 3 is a side view of the first embodiment of the present invention as a long putter.

With reference to FIGS. 1-3, side views of a first embodiment of the present invention are shown as a standard putter, belly putter and long putter, respectively. The golf putter length adjustment holder device 1 is placed over a putter shaft 2 and secured thereto. Because the golf putter length adjustment holder device 1 does not require physical altering to a putter shaft 2 or putter head 3, any person may use the golf putter length adjustment holder device on any putter.

Figure 4:
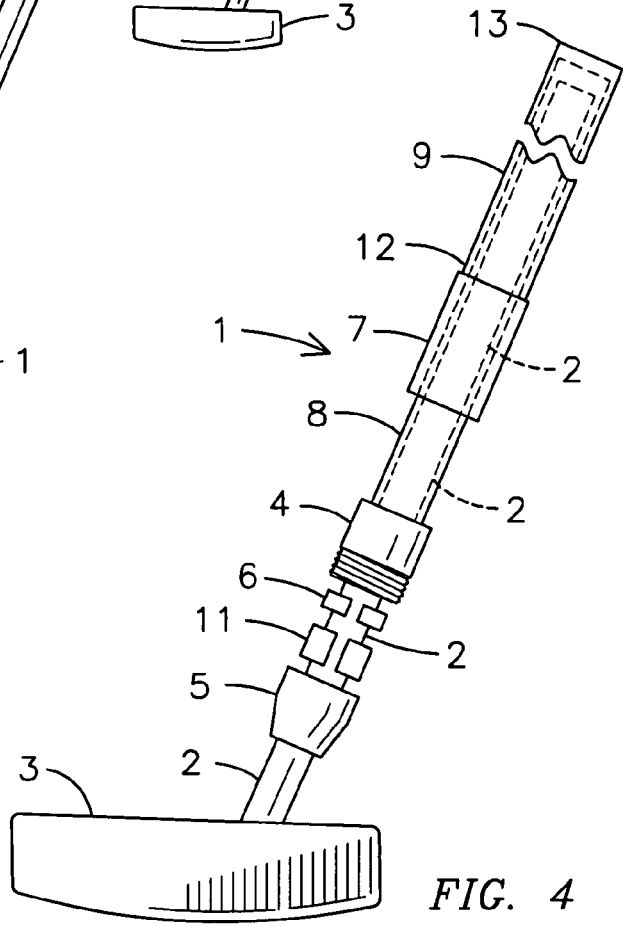
FIG. 4 is a side plan view of the fist embodiment of the present invention.

In FIG. 4, a side plan view of the first embodiment of the present invention. The golf putter length adjustment holder 1 includes a male connector 4 and corresponding female connector 5, a friction locking mechanism 7 a hollow inner tube 8, a hollow outer tube 9 having a first and second end 12 and 13, a split ferrule 6 and a split sleeve 11. To convert a putter using the first embodiment of the present invention, a person first drops the female connector 5, which is preferably tapered, over the putter shaft 2. Then, a person attaches a split ferrule 6 and split sleeve 11 on the putter shaft 2. The use of a split ferrule 6 and split sleeve 11 provides for the proper cinching onto a putter shaft 2 as a putter shaft 2 is not circumferentially equal throughout the length of the putter shaft 2.

Although a ferrule 6 and sleeve 11 are used in the present invention, other devices which are split may also be used, such as split washers. Then, a user places the male connector 4 onto the putter shaft 2. The user then tightens the male connector 4 to the female connector 5 via the external threads located on the male connector 4 and the internal threads on the female connector 5. Because the hollow inner and outer tubes 8 and 9 are connected to the male connecter 4, a person may easily convert the length of the putter to any desired length. The golf putter length adjustment holder device 1 may be used on a putter with or without a grip. In addition, the outer tube 9 may or may not include a grip.

To convert a putter to a belly or long putter using the first embodiment of the present invention, a person simply pulls the golf putter length adjustment holder device 1 up along the putter shaft 2 to a desired length. In addition, markings may be included on the inner tube 8 to show where a person should stop for a belly or long putter.

Figure 5:
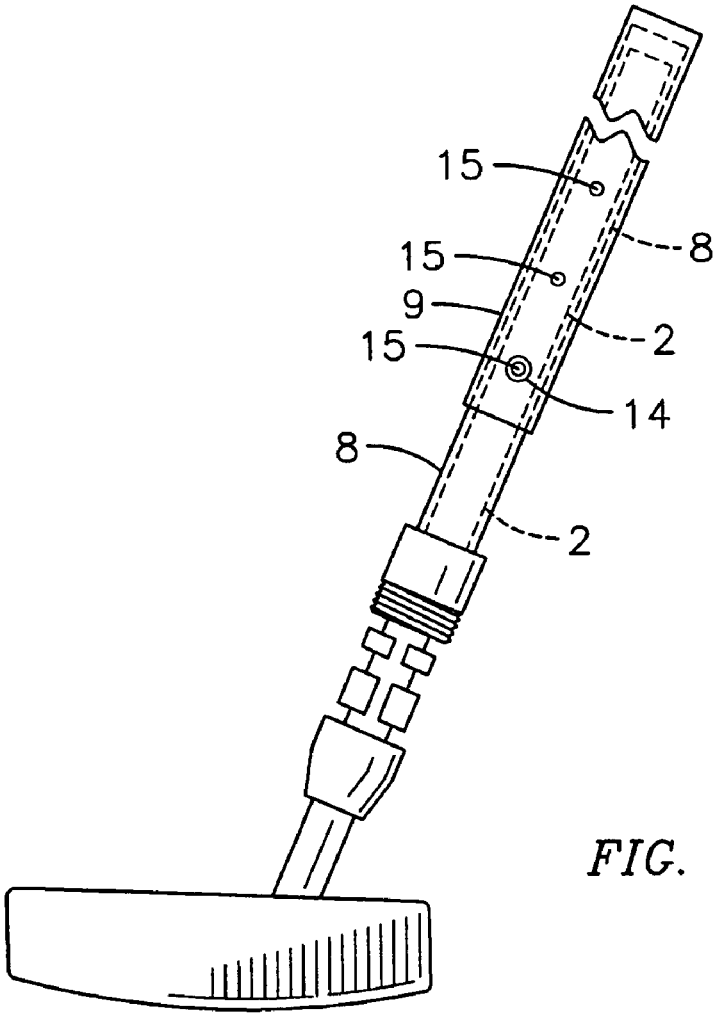
FIG. 5 is a side plan view of a second embodiment of the present invention.

FIG. 5 is a side plan view of a second embodiment of the present invention. Similar to the first embodiment wherein both inner and outer tubes 8 and 9 are used, the second embodiment includes apertures 14 located on the outer tube 8 and at least one nipple 15 located on the inner tube 8. In this embodiment, a user may adjust the length of the golf putter length adjustment holder 1 by pressing the at least one nipple 15 so as to allow slidable movement of the outer tube 9. Then, when the outer tube 9 is at the desired position, the user allows the nipple 15 to enter the aperture 14 to lock the outer tube 9 into place. Thus, rather than using a friction locking mechanism as in the first embodiment, this second embodiment uses apertures 14 and nipples 15.

Figure 6:
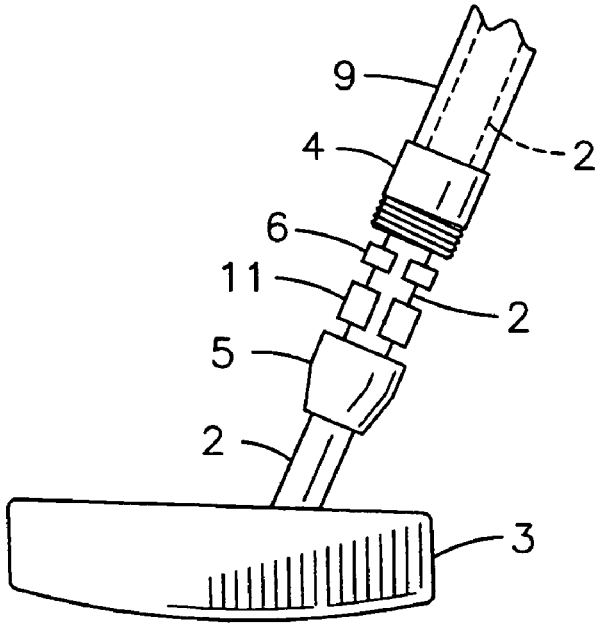
FIG. 6 is a side plan view of a third embodiment of the present invention.

Finally, with respect to FIG. 6, a side plan view of a third embodiment of the present invention is shown. Similar to the first and second embodiments, the third embodiment includes a male and female connector 4 and 5 and a split ferrule 6. However, the third embodiment includes a split sleeve 11 and does not include an inner tube 8. In this embodiment, rather than the golf putter length adjustment holder device 1 being telescopic, a direct connection is made wherein the length of the converted putter is determined by the outer tube 9. Assembly of the third embodiment of the present invention is similar to the first and second. However, because there is no telescoping aspect to this embodiment, a person may begin using the converted putter as soon as the golf putter length adjustment holder device 1 is secured on the putter shaft 2. The outer tube 9 may be internally lined with a material, preferably foam, so as to achieve a tighter fit around the putter shaft 2.

The use of the present invention will allow a person to quickly and easily convert the length of a golf putter without altering the putter itself.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

Having thus described my invention, I claim:

1. A golf putter length adjustment holder device securable to a putter shaft comprising:

a hollow inner tube slidable over said putter shaft;

a hollow outer tube slidably extendable on said inner tube;

said hollow outer tube having a first and second end;

a friction locking mechanism located on said first end of said hollow outer tube;

a male connector secured to said hollow inner tube;

a female connecter slidable over said putter shaft wherein said female connector is securable to said male connector to maintain said hollow inner tube over said putter shaft;

a split ferrule securable to said putter shaft and located within said male and female connectors when said male and female connectors are secured; and a split holder securable to said putter shaft and located within said male and female connectors when said male and female connectors are secured.

2. The golf putter length adjustment holder device of claim 1 wherein:

said male connector is externally threaded; and said female connector is internally threaded.

* * * * *